US007255934B2

(12) United States Patent
Hatono et al.

(10) Patent No.: US 7,255,934 B2
(45) Date of Patent: Aug. 14, 2007

(54) COMPOSITE STRUCTURE BODY AND METHOD AND APPARATUS FOR MANUFACTURING THEREOF

(75) Inventors: Hironori Hatono, Fukuoka (JP); Masakatsu Kiyohara, Fukuoka (JP); Katsuhiko Mori, Fukuoka (JP); Tatsuro Yokoyama, Fukuoka (JP); Atsushi Yoshida, Fukuoka (JP); Tomokazu Ito, Fukuoka (JP); Jun Akedo, Ibaraki (JP)

(73) Assignees: National Institute of Advanced Industrial Science and Technology, Tokyo (JP); Toto Ltd., Fukuoka (JP)

( * ) Notice: Subject to any disclaimer, the term of this patent is extended or adjusted under 35 U.S.C. 154(b) by 333 days.

(21) Appl. No.: 10/399,898

(22) PCT Filed: Oct. 23, 2001

(86) PCT No.: PCT/JP01/09305

§ 371 (c)(1),
(2), (4) Date: Aug. 26, 2003

(87) PCT Pub. No.: WO02/34966

PCT Pub. Date: May 2, 2002

(65) Prior Publication Data

US 2004/0026030 A1 Feb. 12, 2004

(30) Foreign Application Priority Data

Oct. 23, 2000 (JP) ..... 2000-322843

(51) Int. Cl.
*B32B 9/00* (2006.01)

(52) U.S. Cl. ..... 428/688; 428/336

(58) Field of Classification Search ..... None
See application file for complete search history.

(56) References Cited

U.S. PATENT DOCUMENTS 4,219,358 A * 8/1980 Hayashi et al. ..... 106/1.17

(Continued)

FOREIGN PATENT DOCUMENTS

JP 59-080361 5/1984

(Continued)

OTHER PUBLICATIONS

Deposition Method Using Ultrafine Particle Beam and Its Applications; Proceedings of International Symposium on Environmental Conscious Innovative MaterialsProcessing With Advanced Energy Sources (Ecomap-98) Nov. 24-27, 1998, Kyoto, Japan.*

(Continued)

*Primary Examiner*—Jennifer C. McNeil
*Assistant Examiner*—Elizabeth D. Ivey
(74) *Attorney, Agent, or Firm*—Carrier, Blackman & Associates, P.C.; Joseph P. Carrier; William D. Blackman

(57) ABSTRACT

A structure body having the constitution in which the crystals of more than one types of brittle materials such as ceramics, metalloids, and the like are dispersed, a portion composed of the brittle materials is polycrystalline, the crystals constituting the polycrystalline portion substantially lacks the crystalline orientation, and boundary layers composed of glassy substances are substantially absent in the boundary face between the crystals. Accordingly, it is possible to obtain a structure body composed of more than one types of brittle materials and having novel properties without involving a heating/sintering process.

28 Claims, 9 Drawing Sheets

U.S. PATENT DOCUMENTS

| | | | | |
|---|---|---|---|---|
| 5,547,823 | A * | 8/1996 | Murasawa et al. | 430/531 |
| 6,280,802 | B1 * | 8/2001 | Akedo et al. | 427/561 |
| 6,531,187 | B2 * | 3/2003 | Akedo | 427/475 |

FOREIGN PATENT DOCUMENTS

| | | |
|---|---|---|
| JP | 59-087077 | 5/1984 |
| JP | 61-209032 | 9/1986 |
| JP | 06-116743 | 4/1994 |
| JP | 2000-212766 | 8/2000 |

OTHER PUBLICATIONS

New Ceramics (1997: No. 2) pp. 6-13.
New Ceramics (in Japanese) (1998, vol. 11, No. 5).
Materials Integration (2000 vol. 13, No. 4).
The gas deposition Method (Seiichirou Kashu, Kinzoku, Jan. 1989).
The electrostatic fine particle coating method (Ikawa et al., Preprint for the Science Lecture Meeting, Autumn Convention, Precision machine Society Showa 52 (1977)).

* cited by examiner

COMPOSITE STRUCTURE BODY AND METHOD AND APPARATUS FOR MANUFACTURING THEREOF

TECHNICAL FIELD

The present invention relates to a structure body composed of more than one types of brittle materials such as ceramics and semiconductors, a composite structure body formed on a substrate from the structure body, and a method and an apparatus for manufacturing thereof.

The structure body and composite structure body involved in the present invention can be applied to, for example, a nanocomposite magnet, a magnetic refrigerator element, an abrasion resistant surface coat, a higher-order structure piezoelectric element composed of a mixture of piezoelectric materials different in frequency response property, a heating element, a higher-order structure dielectric displaying the characteristics over a wide range of temperature, a photocatalyst material and the induction material thereof, a functional surface coat composed of a mixture of materials having such properties as the water holding property, hydrophilicity, and water repellency, a minute machine part, an abrasion resistant coat for a magnetic head, an electrostatic chuck, a sliding member material, an abrasion resistant coat of a die and mending the abraded and chipped parts thereof, an insulating coat of an electrostatic motor, an artificial bone, an artificial dental root, a condenser, an electronic circuit part, an oxygen sensor, an oxygen pump, a sliding part of a valve, a distortion gauge, a pressure-sensitive sensor, a piezoelectric actuator, a piezoelectric transformer, a piezoelectric buzzer, a piezoelectric filter, an optical shutter, an automobile knock sensor, a supersonic sensor, an infrared sensor, an antivibration plate, a cutting machining tool, a surface coat of a copying machine drum, a polycrystalline solar cell, a dye sensitization type solar cell, a surface coat of a kitchen knife or a knife, the ball of a ball point pen, a temperature sensor, the insulation coat of a display, a superconductor thin film, a Josephson element, a super plastic structure body, a ceramic heating element, a microwave dielectric, a water-repellent coat, an antireflection film, a heat ray reflecting film, a UV absorbing film, an intermetal dielectric layer (IMD), a shallow trench isolation (STI), and the like.

BACKGROUND ART

Among the so-called composite materials, those composite materials which are composed of such brittle materials as ceramics and the like have been developed as structural materials or functional materials, and encompass conventional rather macroscopic materials with particles, fibers, and the like dispersed in the matrices thereof and recent composite mesoscopic materials and nanocomposite materials designed for the composite formation on the crystal level, the recent ones being highlighted. The nanocomposite materials include the intra-crystal nanocomposite type in which nanosize crystals of other materials are introduced either into the interior of a grain or into the grain boundary, and the nano-nanocomposite type in which nanosize crystals of different materials are mixed. Some nanocomposite materials are expected to display hitherto unknown characteristics, and related research papers have been published.

In NEW CERAMICS (1997: No. 2), there is found a description that a raw material is produced in which the ultra-fine particles made of zirconia surround the particles of an alumina raw powder, and the raw material thus produced is sintered to yield a nanocomposite.

In New Ceramics (in Japanese) (1998, Vol. 11, No. 5), there is found a description that a composite powder is produced by depositing Ag particles or Pt particles on the surface of a PZT raw powder in such a way that the surface of ceramic fine particles undergoes a chemical process such as the electroless plating method, and the composite powder thus obtained is sintered to yield a nanocomposite.

Additionally, in New Ceramics (in Japanese) (1998, Vol. 11, No. 5), there is found a description that as the materials for use in preparing nanocomposites, there can be cited $Al_2O_3$/Ni, $Al_2O_3$/Co, $Zr_2O$/Ni, $Zr_2O$/SiC, $BaTiO_3$/SiC, $BaTiO_3$/Ni, ZnO/NiO, PZT/Ag, and the like, and the sintering of these materials gives nanocomposites.

The nanocomposites disclosed in these articles are all obtained by sintering, which induces the grain growth so that the grain size tends to become coarse and large, and accordingly there occurs such a limitation that the sintering does not lead to oxidation; additionally, there is involved the heating process, which does not permit the direct coating of nanocomposite materials onto low-melting point materials. The segregation layer is formed frequently in the grain boundary, and hence there is found a degradation of the freedom in the sense that the crystal particle size control becomes impractical, leading to coarse and large particles in the case where there is large difference in mixing ratio of different powders.

On the contrary to the above described nanocomposites which are obtained by sintering, in Materials Integration (2000, Vol. 13, No. 4), there is found a description that a variety of Cr/$CrO_x$ nanocomposite thin films can be obtained by the reactive low-voltage magnetron sputtering method with a Cr target under the condition that the $O_2$ partial pressure is varied. According to this method, however, it is impossible to conduct the nanosize crystal deposition of mixed fine particles of different types in the form of dispersed particles instead of in the form of laminated layers.

On the other hand, as the recent novel methods of coating film formation, there have been known the gas deposition method (Seiichirou Kashu, Kinzoku (Metals, in Japanese), January, 1989) and the electrostatic fine particle coating method (Ikawa et al., Preprint (in Japanese) for the Science Lecture Meeting, Autumn Convention, Precision Machine Society, Showa 52 (1977)). The fundamental principle of the former method is as follows: the fine particles of metals, ceramics, and the like are converted into aerosols by gas agitation, and accelerated through a fine nozzle so that a part of the kinetic energy is converted into heat when colliding with the substrate, which leads to the sintering found either among the particles or between the substrate and particles. The fundamental principle of the latter method is as follows: the fine particles are charged, accelerated in a gradient of electric field, and the subsequent sintering involves the use of the heat generated in bombardment in a similar manner to that in the former method.

In this connection, as the preceding techniques in which the above descried gas deposition method is applied to mixed fine particles of different types, there have been known the techniques disclosed in Japanese Patent Publication No. 3-14512 (Japanese Patent Laid-Open No. 59-80361), Japanese Patent Laid-Open No. 59-87077, Japanese Patent Publication No. 64-11328 (Japanese Patent Laid-Open No. 61-209032), and Japanese Patent Laid-Open No. 6-116743.

In the contents proposed in the above Japanese Patent Publications, the different types of fine particles are based on such metals (ductile materials) as Ag, Ni, Fe and the like; namely, no specific suggestions are found therein with respect to the formation of the composites of different more than one types of ceramics (brittle materials).

Additionally, the techniques described above take as their fundamental principle the film formation composed of mixed fine particles through melting or partially melting the raw material ultra-fine particles, but without using adhesive agents, so that there are involved such auxiliary heating devices as an infrared heating device and the like.

On the other hand, no nanocomposite was cited therein, but the present inventors proposed a method for producing the films of ultra-fine particles, excluding heating with heating measures, in Japanese Patent Laid-Open No. 2000-212766. In the technique disclosed in this Japanese Patent Laid-Open No. 2000-212766, a structure body is formed through promoting the mutual bonding of the ultra-fine particles in such a way that the ultra-fine particles of 10 nm to 5 μm in particle size are irradiated with an ion beam, an atomic beam, a molecular beam, a low-temperature plasma, or the like, in order to activate the ultra-fine particles without melting thereof and blow them onto a substrate at a rate of 3 m/sec to 300 m/sec.

The above described prior arts can be summarized as follows: the prior composites referred to as nanocomposites are obtained by sintering almost without exception, and the sintering is inevitably accompanied by the crystal grain growth, leading to the larger average grain size of the composites as compared to that of the raw material fine particles, and hence inducing the difficulty in obtaining such composites as excellent in strength and denseness; in this connection, a proposal has been made for suppressing the crystal grain growth, but the fact is that there is found some limitation to the types of raw materials to which the proposal is applicable.

Furthermore, even a method of coating film formation with fine particles involving no sintering needs some kind of surface activation procedure, almost no considerations are given to the ceramics, and exactly no reference is made to the nanocomposites composed of more than one types of brittle materials such as ceramics and the like.

The present inventors have been engaged in the subsequent check and confirmation investigation on the technique disclosed in Japanese Patent Laid-Open No. 2000-212766. Consequently, the present inventors have been successful in revealing that there is definite difference in behavior between metals (ductile materials) and brittle materials including ceramics and semiconductors.

More specifically, as for the brittle materials, the structure bodies were able to be formed without using the irradiation of the ion beam, atomic beam, molecular beam, low-temperature plasma, or the like, namely, without using any particular activation procedure, although there was still a problem that the structure bodies were unsatisfactory in the peel strength or partially tended to be peeled off or the density is not uniform, when there were implemented just the fine particle size of 10 nm to 5 μm and bombardment velocity of 3 m/sec to 300 m/sec as specified in the conditions described in the above mentioned patent laid-open.

On the basis of the above described considerations, the present inventors reached the following conclusions.

The ceramics take the atomic bonding condition that the free electrons are scarcely found and the covalent bonding or the ionic bonding is predominant. Thus, they are hard but brittle. The semiconductors such as silicon, germanium and the like are also brittle materials without ductility. Accordingly, when mechanical impact is exerted to the brittle materials, for example, the crystal lattice dislocation occurs along such a cleavage plane as the boundary face of the crystallites, or the fracture occurs. Once these phenomena have occurred, there are found such atoms as exposed on the dislocation plane and the fracture plane, although these atoms have been originally located in the interior where they have been bonded to other atoms; namely, a new surface is thus formed. The atomic single layer part on the new surface is forced by the external force to make transition to the exposed and unstable surface state from the originally stable atomic bonding state, giving rise to, in other words, a high surface energy state. This activated surface is bonded to the adjacent surface of the brittle material as well as another adjacent new surface of the brittle material or the adjacent substrate surface, thus being converted to a stable state. Exertion of continuous, external mechanical impact makes this phenomenon to occur continuously, and the accompanying repeated distortion and fracture of the fine particles lead to the joining development, densifying the thereby formed structure body. Thus, the structure bodies of the brittle materials are formed.

DISCLOSURE OF THE INVENTION

The present invention has been perfected on the basis of the idea that since as described above the formation of new surfaces in the brittle materials makes it possible to form the structure bodies, a brittle material can be taken as a combination of a constituent material and a binder, and hence a composite structure body can be formed with more than one types of brittle materials, the composite structure body thus formed being expected to have hitherto unknown characteristics.

The microscopic structure of the composite structure bodies involved in the present invention formed on the basis of the above described knowledge is obviously different from that of the structure bodies obtained by the conventional production methods.

More specifically, in the constitution of the structure bodies involved in the present invention, there are dispersed the crystals of first brittle materials such as ceramics, semiconductors, and the like, and the crystals and/or microstructures (the amorphous grain ascribable to the structure of the raw material fine particles or the flake structures definitely different from segregation layers) of second brittle materials other than the first brittle materials; and the portion composed of the brittle material crystals (the portions other than the microstructures) is polycrystalline, while the crystals constituting the polycrystalline portions substantially lack the crystalline orientations, and the boundary face between the crystals substantially has no boundary layers composed of glassy substances.

Additionally, a composite structure body is formed through formation of the above described structure body on a substrate surface, and in this case a portion of the structure body becomes the anchor portion biting the substrate surface.

Here are explained the technical terms important for the purpose of understanding the present invention as follows.

(Polycrystal)

In the present specification, this term means a structure body which is formed through the joining and agglomeration of crystallites. A crystallite alone substantially constitutes a crystal, the size of which is 5 nm or more. However, there rarely occurs the case in which fine particles are incorporated, without undergoing fracture, into the structure body, and the like cases; nevertheless, the structure bodies in these cases substantially can be regarded as polycrystalline.

(Crystalline Orientation)

In the present specification, this term means the orientation of the crystal axes in a polycrystalline structure body, and the estimation as to whether the orientation is present or absent is made by reference to the JCPDS (ASTM) data which was prepared as the standard data by the powder X-ray analysis and the like of the powders that were regarded as substantially lacking the orientation.

In the present specification, the substantial absence of the orientation refers to the following condition: when the 100% intensities are allotted to the respective intensities of the main three diffraction peaks in the above reference data that cite the material constituting the brittle material crystals in the structure body, and the intensity of the strongest main peak in the same brittle material in the structure body is taken to be the same as that of the corresponding reference intensity, the intensities of the other two peaks fall within 30% in deviation as compared to the corresponding reference data intensities.

(Boundary Face)

In the present specification, this term means the regions which constitute the mutual boundaries between the crystallites.

(Boundary Layer)

This term means the layer having a certain thickness (usually, a few nm to a few μm) which is situated in the boundary face or in the grain boundary as referred to for the sintered body; this layer usually takes an amorphous structure different from the crystal structure found in a crystal particle, and is in some cases accompanied by the impurity segregation.

(Anchor Portion)

In the present specification, this term means the irregularities formed on the interface between the substrate and the structure body; in particular, this term means the irregularities formed by varying in the structure body formation the surface precision of the original substrate, but does not mean the irregularities formed on the substrate in advance of the structure body formation.

(Average Crystallite Size)

This term means the crystallite size which is calculated by the Scherrer method in the X-ray diffraction method, and is measured and calculated by means of, for example, an MXP-18 apparatus manufactured by MacScience Co.

(Internal Distortion)

This term means the lattice distortion found in the fine particles which is calculated by the Hall method in the X-ray diffractometry, and is represented in percentages as the deviation found by reference to the standard material prepared by full annealing of fine particles.

(Brittle Material Fine Particle, Composite Fine Particle, Velocity of Composite Material Fine Particle)

The above velocity means the average velocity calculated according to the measurement method on the fine particles as shown in Example 4.

As for the conventional nanocomposites formed by sintering, the crystals are accompanied by the thermal grain growth, and glassy layers are formed as boundary layers particularly in the case where sintering aids are used.

On the other hand, in the structure bodies involved in the present invention, the distortion or fracture goes with the brittle material fine particles among the raw material fine particles, and accordingly the constituent grain of the structure bodies are smaller than the raw material fine particles. With the average fine particle size of, for example, 0.1 to 5 μm as measured by the laser diffraction method or the laser scattering method, the average crystallite size of a formed structure body frequently becomes 100 nm or less, and the polycrystals composed of such fine crystallites are contained in the structures of the structure body. Consequently, there can be formed the dense structure body that is 500 nm or less in the average crystallite size and 99% or more in the denseness degree, 100 nm or less in the average crystallite size and 95% or more in the denseness degree, or 50 nm or less in the average crystallite size and 70% or more in the denseness degree.

Here, the denseness degree (%) is calculated by the formula, the bulk specific gravity÷the true specific gravity× 100(%), where the true specific gravity is based on the literature value or theoretical calculated value and the bulk specific gravity is obtained from the weight and volume values of the structure body.

Additionally, the structure bodies involved in the present invention are characterized in that: the structure bodies are accompanied by the distortion or fracture induced by such mechanical impact as bombardment and the like so that the crystal shapes of flat or thin and long are difficult to exist, and the forms of the involved crystallites can be regarded as nearly particle-like and the aspect ratio nearly amounts to 2.0 or less; and additionally, the structure is ascribable to the rejoining fraction of the fractured fragment particles, and accordingly lack the crystal orientation and are almost dense, so that the structure bodies are excellent in such mechanical and chemical properties as hardness, abrasion resistance, corrosion resistance, and the like.

Additionally, in the present invention, it takes a very short time to cover from the fracturing and to the rejoining of the brittle material fine particles, so that at the time of joining the atomic diffusion hardly occurs in the vicinity of the surface of the fine fragment particles. Accordingly, the atomic disposition in the boundary face between the crystallites of the structure body is free from disturbance, and the boundary layers (glassy layers), namely, the molten layers, are hardly formed, or are 1 nm or less even if formed. Thus, the structure bodies display the characteristic excellent in such chemical properties as the corrosion resistance and the like.

Additionally, the structure bodies involved in the present invention include those structure bodies which have the nonstoichiometric composite portion, namely, the deficient portion and superfluous portion (for example, deficient in oxygen, containing physically adsorbed water, or bonded with hydroxyl groups) in the vicinity of the boundary face constituting the structure body. As a nonstoichiometric deficient portion, here can be cited the portion ascribable to the oxygen deficiency in the metal oxide which constitutes a composite structure body. The presence of the nonstoichiometric portion can be recognized through the alternative characteristic such as the electric resistance, and by use of the composition analysis based on the TEM or EDX analysis or the like.

Additionally, as the substrates on the surfaces of which the structure bodies involved in the present invention are formed, there can be cited glass, metals, ceramics, semiconductors, or organic compounds; and as the brittle materials, there can be cited the oxides including aluminum oxide, titanium oxide, zinc oxide, tin oxide, iron oxide, zirconium oxide, yttrium oxide, chromium oxide, halfnium oxide, beryllium oxide, magnesium oxide, silicon oxide, and the like; diamond and the carbides including boron carbide, silicon carbide, titanium carbide, zirconium carbide, vanadium carbide, niobium carbide, chromium carbide, tungsten carbide, molybdenum carbide, tantalum carbide, and the like; the nitrides including boron nitride, titanium nitride, aluminum nitride, silicon nitride, niobium nitride, tantalum nitride, and the like; boron and the borides including aluminum boride, silicon boride, titanium boride, zirconium boride, vanadium boride, niobium boride, tantalum boride, chromium boride, molybdenum boride, tungsten bonde, and the like; or the mixtures and the multicomponent-system solid solutions of these substances; the piezoelectric/pyroelectric ceramics including barium titanate, lead titanate, lithium titanate, strontium titanate, aluminum titanate, PZT, PLZT, and the like; the tough ceramics including sialon, cermet, and the like; the biocompatible ceramics including hydroxy apatite, calcium phosphate, and the like; silicon, germanium, and the metalloid substances composed of silicon or germanium doped with various dopants including phosphorus and the like; and the semiconducting compounds including gallium arsenide, indium arsenide, cadmium arsenide, and the like. Furthermore, in addition to these inorganic materials, there can be cited the brittle organic materials including hard vinyl chloride, polycarbonate, acryl, unsaturated polyester, polyethylene, poly(ethylene terephthalate), silicone, fluorocarbon resins, and the like.

Additionally, the thickness of the structure body in the present invention (exclusive of the substrate thickness) can be made to be 50 μm or more. The surface of the above mentioned structure body is not flat and smooth microscopically. The flat and smooth surface is required, when an abrasion-resistant sliding member is produced, for example, by coating the surface of a piece of metal with a highly hard composite structure body (a nanocomposite), and accordingly surface grinding or polishing is necessary in a later process. In such application, it is desirable that the deposition height of the composite structure body is made to be of the order of 50 μm or more. When surface grinding is conducted, it is desirable that the deposition height is 50 μm or more because of the mechanical restriction imposed on the grinding machine; in this case, the grinding of several tens of micrometers is carried out, so that the surface of 50 μm or less comes to form a flat and smooth thin film.

Additionally, in some cases, it is desirable that the thickness of the structure body is 500 μm or more. The present invention takes as an object not only the production of the composite structure body film which is formed on a substrate made of a metallic material or the like and has the functions such as the high hardness, abrasion resistance, heat resistance, corrosion resistance, chemical resistance, electric insulation and the like, but also the production of the composite structure body which can be used alone. Although the mechanical strengths of the ceramic materials are diverse, a structure body of 500 μm or more in thickness can give the strength sufficient for application to, for example, the ceramic substrates and the like, as far as the qualities of the materials are properly chosen.

For example, it is possible to produce a mechanical component made of a composite material at room temperature in the following way: the composite material ultra-fine particles are deposited on the surface of a sheet of metal foil placed on the substrate holder to form a dense structure body which is 500 μm or more in thickness all over the structure body or partially, and subsequently the metal foil part is removed or some other like process is performed.

On the other hand, the method for manufacturing the composite structure body in the application concerned forms the structure body composed of the structures in which the crystals and/or microstructures of the brittle material are dispersed, in the following manner: the fine particles of more than one types of the brittle materials are simultaneously or separately bombarded against the substrate surface at high velocities; the brittle material fine particles are distorted or fractured by the bombardment impact; the mutual rejoining of the fine particles is made through the intermediary of the newly generated active surface formed by the distortion or fracture, and furthermore the anchor portion biting the substrate surface is formed to join with the substrate.

As the procedures in which the fine particles of more than one types of brittle materials are bombarded at high velocities, there can be cited the carrier gas method, the method accelerating the fine particles by use of the electrostatic force, the thermal spraying method, the cluster ion beam method, the cold spray method, and the like. Among these methods, the carrier gas method is conventionally referred to as the gas deposition method, and is a method for forming a structure body in which the aerosol containing the fine particles of metals, semiconductors, or ceramics is blown off from a nozzle and is sprayed at a high speed onto the substrate to deposit the fine particles on the substrate, and there is thereby formed a deposition layer of the green compacts having the same composition as that of the fine particles and the like layers. Here, among these methods, in particular, the method for forming structure bodies directly on the substrate will be referred to as the ultra-fine particles beam deposition method or the aerosol deposition method; in the present specification, the manufacturing method involved in the present invention will be referred to as this name in what follows.

When the aerosol of the material fine particles is bombarded by use of the ultra-fine particles beam deposition method, the mixed powder aerosol may be prepared beforehand, or the aerosols of the individual materials may be generated and bombarded either independently or simultaneously while varying the mixing ratio of the aerosol. The last case is preferable in the sense that a structure body having a declined composition can be easily formed.

The method for manufacturing the composite structure bodies involved in another embodiment of the present invention includes the method in which the composite fine particles are formed through the process of coating the surface of the brittle material fine particles with another brittle material, and subsequently the composite fine particles are bombarded against a substrate surface at a high velocity.

As the method for coating the surface of the fine particles with another brittle material, the procedure mimicking the PVD, CVD, or mechanical alloying method may be adopted, or it may be sufficient that ultra-fine particles further smaller in particle size are only made to adhere by kneading or the like onto the surface of the fine particles.

The method for manufacturing the composite structure bodies involved in yet another embodiment of the present invention forms a structure body comprising the structure in which brittle material crystals and/or microstructures are dispersed on the anchor portion in the following manner: the fine particles of more than one types of brittle materials are arranged on the substrate surface; a mechanical impact is exerted to the brittle material fine particles, and the brittle material fine particles are deformed or fractured by the impact; the mutual rejoining of the fine particles is made through the intermediary of the active surface newly generated by the distortion or fracture, and furthermore the anchor portion partially biting the substrate surface is formed in the boundary portion between the substrate and/or the brittle material fine particles to join with the substrate;

and there is thus formed the structure body in which the brittle material crystals and/or microstructures are dispersed on the anchor portion.

In this case, similarly to the above described case, there may be used the composite fine particles which are formed by coating the surface of the brittle material fine particles with another brittle material.

As described above, the present invention has paid attention to the active surface newly generated by the distortion or fracture induced when the impact is exerted to the brittle material fine particles. In this connection, if the internal distortion of the brittle material fine particles is small, the brittle material fine particles are hardly distorted or fractured when bombarded; on the contrary, if the internal distortion of the brittle material fine particles is large, large cracking is induced for cancellation of the internal distortion, accordingly the brittle material fine particles undergo fracture/agglomeration before bombardment, and the bombardment of the agglomerates thus formed against the substrate hardly leads to the formation of the newly generated surface. Consequently, for the purpose of obtaining the composite structure body involved in the present invention, the particle size and the bombardment velocity of the brittle material fine particles are of course important, but it is even more important to provide the brittle material fine particles as the raw material with the internal distortion falling within the prescribed range. The most preferable internal distortion is such a distortion as is increased up to the limit immediately beyond which the crack comes to be formed, but such fine particles with some crack formed but with some remaining internal distortion can be satisfactorily used.

In the method for manufacturing the composite structure body involved in the present invention (the ultra-fine particles beam deposition method), it is preferable to use the brittle material fine particles which have the average particle size ranging from 0.1 to 5 μm and the large internal distortion formed beforehand. The velocity of the above particles falls within the range preferably from 50 to 450 m/s, more preferably from 150 to 400 m/s. These conditions are intimately related to whether the newly generated surface is formed when the particles are bombarded against the substrate and in other like cases; the particle size smaller than 0.1 μm is too small and hardly induces the fracture or distortion. When the average particle size exceeds 5 μm, the fracture occurs partially, but substantially there comes to operate the film abrasion effect ascribable to etching, and it is sometimes the case that the process goes no further than the deposition of the green compacts made of the fine particles without causing fracture. Similarly, when a structure body is formed with this average particle size, there has been observed the phenomenon in which the green compacts are mixed in the structure body at the particle velocity of 50 m/s or less, and it has been found that at the particle velocity of 450 m/s or more, the etching effect becomes appreciable and the structure body formation efficiency becomes degraded. The method of measuring these velocities is based on Example 4.

One of the characteristics of the method of manufacturing the composite structure body involved in the present invention consists in that the manufacturing can be conducted at room temperature or at relatively low temperatures, which permits the choice of such low-melting point materials as resins as the substrate.

However, a heating process may be added to the method of the present invention. The formation of the structure body of the present invention is characterized in that in the structure body formation, there hardly occurs the heat generation at the time of the distortion/fracture formation of the fine particles, and nevertheless a dense structure body is formed; the structure body can be formed satisfactorily in the environment of room temperature. Accordingly, although heat is not necessarily required to be involved in the structure body formation, it is conceivable that the heating of the substrate or the heating of the environment for forming the structure body is conducted for the purpose of drying the fine particles and removal of the surface adsorbates, heating for activation, aiding the anchor portion formation, alleviation of thermal stress between the structure body and the substrate in consideration of the environment in which the structure body is used, removal of the substrate surface adsorbates, and improvement of the efficiency of the structure body formation. Even if this is the case, it is not necessary to apply such a high temperature as inducing the melting, sintering, or extreme softening of the fine particles and substrate. Additionally, it is also possible to conduct the structure control of the crystal by the heat processing at the temperatures not higher than the melting point of the brittle material, after the formation of the structure body composed of the polycrystalline brittle material.

Additionally, it is preferable to implement under a reduced pressure the method of manufacturing the composite structure body involved in the present invention, in order to maintain to some extent of time the activity of the newly generated surface formed on the raw material fine particles.

Additionally, when the method of manufacturing the composite structure body involved in the present invention is embodied on the basis of the ultra-fine particles beam deposition method, it is conceivable to control the electric characteristics, mechanical characteristics, chemical characteristics, optical characteristics, and magnetic characteristics of the structure body by controlling the element quantities in the compounds constituting the structure body composed of the brittle material and the oxygen quantity in the structure body through controlling the type and/or partial pressure of the carrier gas such as oxygen.

In other words, if such an oxide as aluminum oxide is used as the raw material fine particles in the ultra-fine particles beam deposition method, and the structure body is formed by suppressing the partial pressure of the oxygen used in this method, it is conceivable that the oxygen escapes into the gas phase from the surface of the fine fragment particles when the fine particles undergo fracture to yield the fine fragment particles, and accordingly the oxygen deficiency and the like occur on the surface phase. There occurs thereafter the mutual rejoining of the fine fragment particles, and consequently the oxygen deficient layer is formed in the vicinity of the boundary face between the crystal grain. Additionally, the element to be made deficient is not limited to oxygen, but may include nitrogen, boron, carbon, and the like; it is conceivable that the deficiency of these elements is achieved by the nonequilibrium state partition of the elemental quantities between the gaseous and solid phases or by the reaction-induced elimination of the elements, through controlling the partial pressures of the particular types of gases.

Additionally, the apparatus for manufacturing the composite structure body involved in the present invention is characterized in that the apparatus comprises an aerosol generator for generating the aerosol which is generated by dispersing the fine particles of more than one types of brittle materials in the gas, a nozzle for spraying the aerosol against the substrate, and a classifier which classifies the brittle material fine particles in the aerosol.

Additionally, the apparatus for manufacturing the composite structure body involved in the present invention is characterized in that the apparatus comprises a disintegrating machine which disintegrates the agglomeration of the brittle material fine particles in the aerosol, instead of the classifier or in combination with the classifier.

Furthermore, the apparatus for manufacturing the composite structure body involved in the another embodiment is characterized in that the apparatus comprises a coating unit which forms the composite fine particles by coating the surface of the brittle material fine particles with one or more types of brittle materials different from the above described fine particles of the brittle materials, an aerosol generator, and a nozzle for spraying the aerosol.

It is possible to provide a disintegrating machine, between the above described aerosol generator and the above described nozzle, which disintegrates the agglomeration of the above described composite fine particles in the aerosol and/or a classifier which classifies the above described composite fine particles in the above described aerosol.

Additionally, it is also possible to provide a distortion imparting unit which impresses the internal distortion to the brittle material fine particles or the composite fine particles.

Detailed Description Including Best Mode of Carrying Out the Invention

In the next place, description is made below of an embodiment of the method and apparatus for manufacturing a structure body which are based on the present invention.

Figure 1:
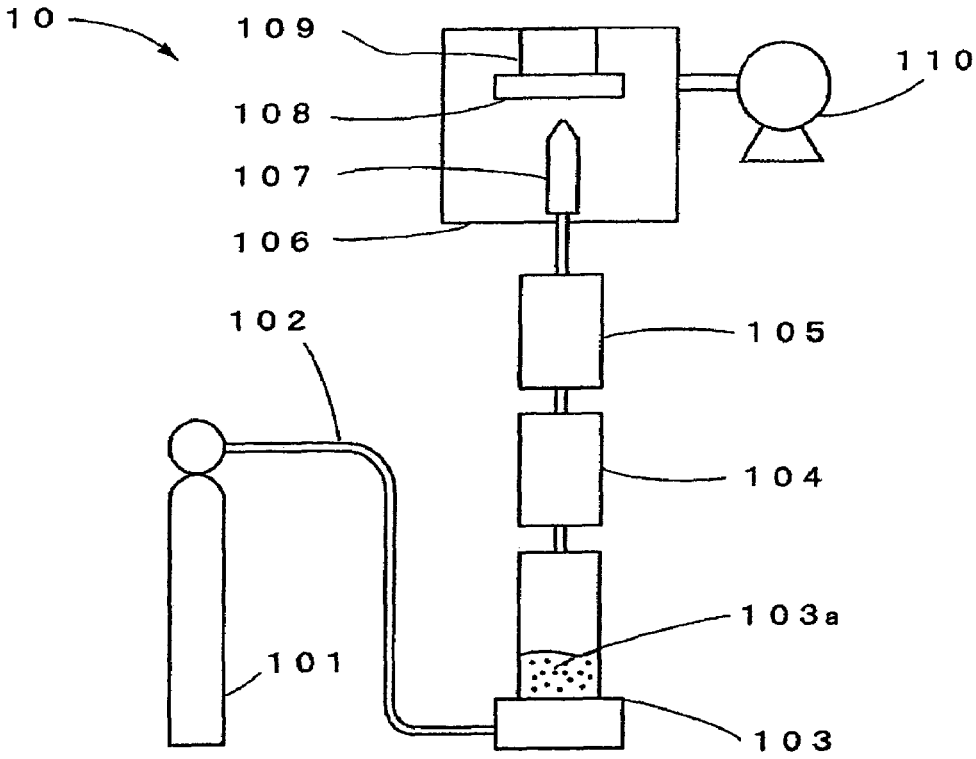
FIG. 1 shows a diagram illustrating an apparatus for manufacturing a structure body as an embodiment of the present invention.

FIG. 1 shows an embodiment of the apparatus 10 for manufacturing a composite structure body, in which apparatus a nitrogen gas cylinder 101 is connected, through a carrier pipe 102, to an aerosol generator 103, a disintegrating machine 104 is arranged at a position downstream thereof, and a classifier 105 is arranged at a position further downstream thereof. A nozzle 107, arranged in a structure body formation chamber 106, is arranged at one end of the carrier pipe 102 communicatively connecting these above described devices. In front of the opening of the nozzle 107, there is arranged a substrate 108 made of iron which is mounted on an XY stage 109. The structure body formation chamber 106 is connected to a vacuum pump 110. The aerosol generator 103 stores internally the mixed powder 103*a* composed of the aluminum oxide fine particles and silicon oxide fine particles.

Description is made below of the operation of the apparatus 10 for manufacturing a composite structure body which apparatus comprises the above described configuration. The mixed powder 103*a* is prepared by mixing the aluminum oxide fine particles and silicon oxide fine particles both imparted the internal distortion by pulverizing beforehand with a planetary mill that is the distortion imparting unit unshown in the figure, and the mixed power 103*a* is put into the aerosol generator 103. The nitrogen gas is introduced, from the nitrogen gas cylinder 101 through the carrier pipe 102, into the aerosol generator 103 charged with the mixed powder 103*a*, and the aerosol generator 103 is operated to generate the aerosol containing the aluminum oxide fine particles and silicon oxide fine particles. The fine particles in the aerosol are agglomerated to form the secondary particles of about 100 μm, which are introduced through the carrier pipe 102 into the disintegrating machine 104 to be converted to the aerosol containing the primary particles in a large fraction. The aerosol is thereafter introduced into the classifier 105 to remove the coarse secondary particles in the aerosol remaining undisintegrated by the disintegrating machine 104, so that the aerosol is converted to the aerosol further enriched in the primary particles, and then guided out therefrom. Then, the aerosol is sprayed at a high speed against the substrate 108 from the nozzle 107 arranged in the structure body formation chamber 106. While bombarding the aerosol against the substrate 108 arranged in front of the nozzle 107, the substrate 108 is fluctuated with an XY stage 109 to form a thin film structure body over a certain area on the substrate 108. The structure body formation chamber 106 is placed in an environment with a reduced pressure of about 10 kPa provided by a vacuum pump 110.

Incidentally, among the above described structure body formation processes, the aerosol generator 103, disintegrating machine 104, and classifier 105 may be either of the separated type or of the integrated type. When the performance of the disintegrating machine is sufficiently satisfactory, no classifier is needed. Additionally, as for the mill pulverization of two types of fine particles, the mill pulverization may be conducted with the powder mixed beforehand, or the two types of fine particles may be pulverized separately for each type, and then mixed together. When the respective fine particles are extremely different in hardness, the composite fine particles may be prepared as follows: the mill pulverization after mixing impresses the internal distortion and simultaneously crushes the softer fine particles, and the crushed softer fine particles coat the surface of the harder fine particles. In other words, this case leads to the structure body formation based on the composite fine particles. Of course, it is possible to apply the composite fine particles prepared by some another method to this apparatus for manufacturing a composite structure body formation; the composite fine particles can be prepared beforehand not only by the mill pulverization but also by a variety of methods such as the PVD, CVD, plating, sol-gel methods, and the like.

It is preferable that the composition of the structure body can be controlled without restraint because the type of the brittle material fine particles is not limited to two types, but many types can be easily mixed together and the mixing ratio can be optionally specified. This is also the case for the composite fine particles. The gas used is not limited to nitrogen gas, but can be arbitrarily argon, helium, or the like; it is conceivable that the oxygen concentration in the structure body is varied by mixing oxygen with these cited gases.

Figure 2:
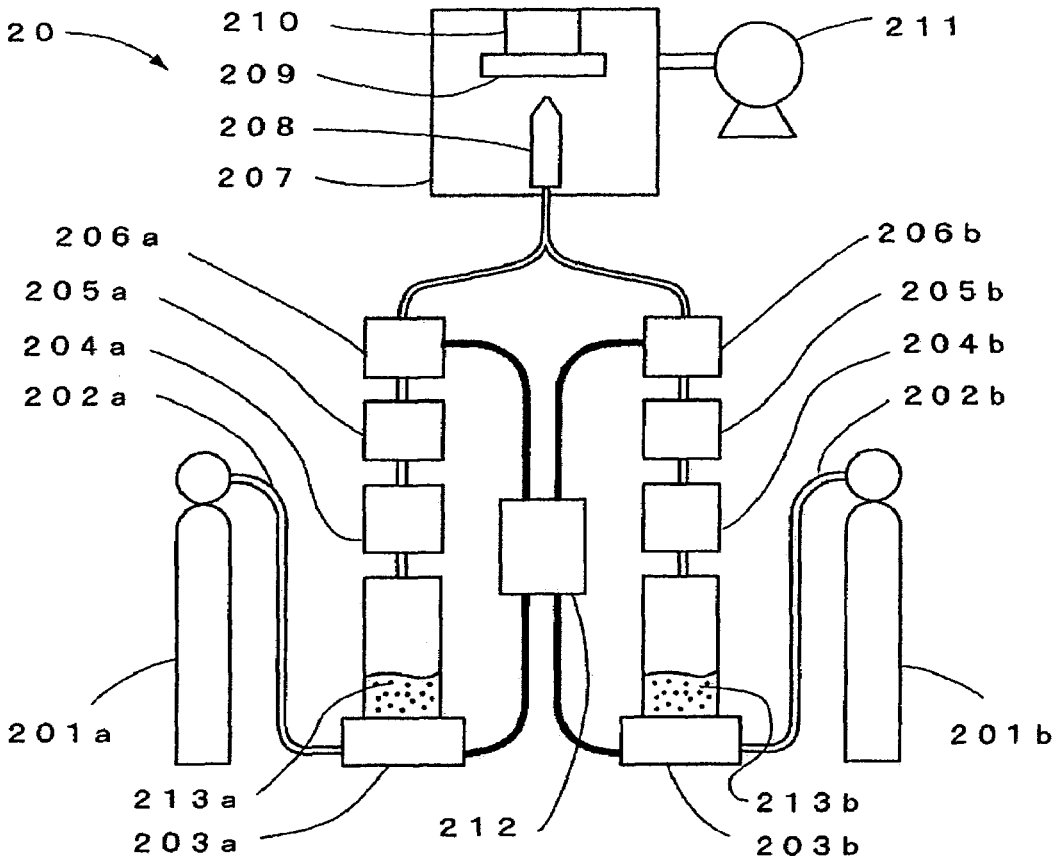
FIG. 2 shows a diagram illustrating an apparatus for manufacturing a structure body as an embodiment of the present invention.

FIG. 2 shows the apparatus for manufacturing the composite structure body of the another embodiment in the present invention; in the apparatus 20 for manufacturing the composite structure body, argon gas cylinders 201*a*, 201*b* are connected, through carrier pipes 202*a*, 202*b*, respectively to aerosol generators 203*a*, 203*b*, disintegrating machines 204*a*, 204*b* are arranged at further downstream positions, classifiers 205*a*, 205*b* are arranged at further downstream positions, and aerosol concentration measurement instruments 206*a*, 206*b* are arranged at further downstream positions. The carrier pipes 202*a*, 202*b* communicatively connecting these are merged at positions downstream of the aerosol concentration measurement instruments 206*a*, 206*b*, and communicatively connected to a nozzle 208 arranged in a structure body formation chamber 207.

In front of the opening of the nozzle 208, there is arranged a metallic substrate 209 mounted on an XY stage 210. The structure body formation chamber 207 is connected to a vacuum pump 211. Additionally, the aerosol generators 203*a*, 203*b* and the aerosol concentration measurement instruments 206*a*, 206*b* are wired to a controller 212. The aerosol generators 203*a*, 203*b* store internally fine particles 213*a*, 213*b* of different types of brittle materials of the order of 0.5 μm in average particle size.

Description is made below of the operation of the apparatus 20 for manufacturing a composite structure body which apparatus comprises the above described configuration. The brittle material fine particles 213*a*, 213*b*, both imparted the internal distortion by pulverizing beforehand with a planetary mill that is the distortion imparting unit unshown in the figure, are respectively put into the aerosol generators 203*a*, 203*b*. Then, the valves of the argon gas cylinders 201*a*, 201*b* are opened and the respective argon gases are introduced into the aerosol generators 203*a*, 203*b*, through the carrier pipes 202*a*, 202*b*. Receiving the control of the controller 212, the aerosol generators 203*a*, 203*b* operate to respectively generate the aerosols. The fine particles are agglomerated in these aerosols to form the secondary particles of the order of 100 μm, which are introduced into the disintegrating machines 204*a*, 204*b* and are converted to the aerosols enriched in the primary particles. Subsequently, the aerosols are introduced into the classifiers 205*a*, 205*b* to remove the coarse secondary particles in the aerosols remaining undisintegrated by the disintegrating machines 204*a*, 204*b* so that the aerosols are converted to the aerosols further enriched in the primary particles, and then guided out therefrom. Then, these aerosols pass through the aerosol concentration measurement instruments 206*a*, 206*b*, where the fine particle concentrations in the aerosols are monitored, and then are merged and sprayed at a high speed against the substrate 209 from the nozzle 208 arranged in the structure body formation chamber 207.

The substrate 209 is fluctuated with the XY stage 210, and accordingly by varying the bombardment position of the aerosol against the substrate 209 from moment to moment, the fine particles are bombarded against a wide area on the substrate 209. The brittle material fine particles 213*a*, 213*b* are crushed or distorted when colliding, and these particles are joined to form a dense structure body in which the crystals of different types of brittle materials are present as independently dispersed with the crystal size not larger than the average particle size of the primary particles, namely, with the nanometer size. Additionally, the interior of the structure body formation chamber 207 is evacuated with the vacuum pump 211, and the internal pressure is controlled to take a constant value of about 10 kPa.

Thus, on the substrate 209 is formed the structure body in which the different types of brittle materials are dispersed; in this case the results monitored on the aerosol concentration measurement instrument 206*a*, 206*b* are analyzed by the controller 212, and fed back to the aerosol generators 203*a*, 203*b*, to control the generated amount and concentration of the aerosol so that the abundance ratios of the different types of brittle materials in the structure body can be controlled either to be constant or to be inclined. In the case where such inclined materials are manufactured, the abundance ratios are easily varied either along the deposition height direction or the abundance distributions are easily varied along the surface direction of the substrate 209, in conjunction with the XY stage. Additionally, it is also possible to form a structure body by spraying a plurality of types of aerosols, without being merged, through separate nozzles. In this case, there is obtained a structure body composed of a thin deposited layer, and the inclination generation is easily carried out by controlling the thickness. Additionally, the fine particles stored internally in the aerosol generators may be either composite fine particles or mixed fine particles of a plurality of brittle materials; there only have to be chosen the internal storage modes suitable for achieving the target structure of the structure body. The gas composition is also optional.

EXAMPLE 1

Figure 3:
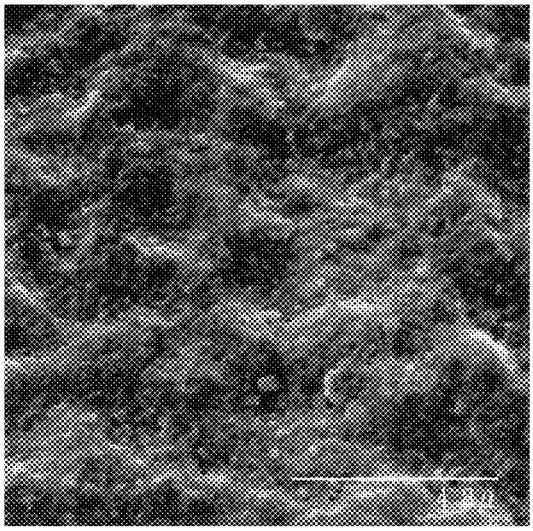
FIG. 3 shows the SEM image of a structure body composed of aluminum oxide and silicon oxide.
Figure 4:
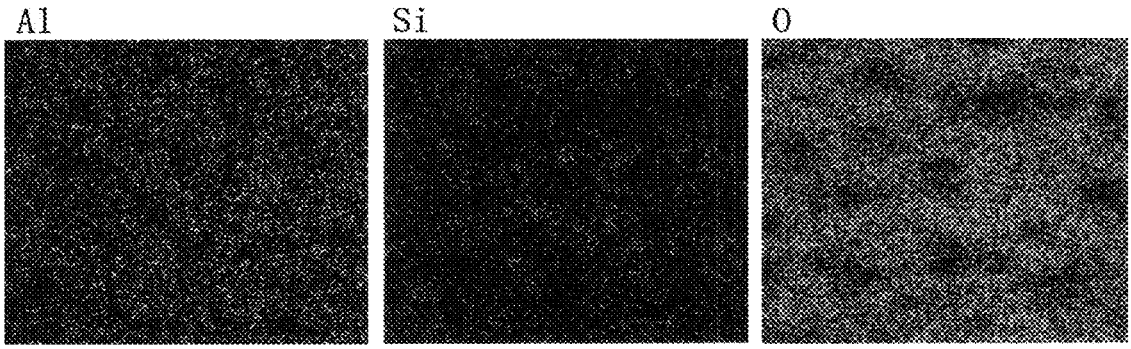
FIG. 4 shows the photographs displaying the results of the element distribution measurement by an EPMA of aluminum, silicon, and oxygen.

There was prepared beforehand the mixed powder composed of the aluminum oxide fine particle powder of 0.4 μm in average particle size with the distortion imparted by a planetary mill and the silicon oxide fine particle powder of 0.5 μm in average particle size with the distortion similarly imparted by a planetary mill, and with this powder, a dense composite structure body was formed on an iron substrate by means of the ultra-fine particles beam deposition method, in which structure body the elemental ratio between aluminum and silicon was 75% vs. 25%. The used apparatus corresponded to the one shown in FIG. 1. FIG. 3 shows the structure body surface SEM photograph taken immediately after the formation. FIG. 4 shows the results of the element distribution of aluminum, silicon, and oxygen in this location measured by an EPMA. In these results, the crystallites of 100 nm or less are dispersed independently with no orientation condition, and no solid solution layer composed of aluminum oxide and silicon oxide has been confirmed in the vicinity of the interface. Additionally, the anchor layer portion was formed in the interface between the composite structure body and the substrate.

EXAMPLE 2

Figure 5:
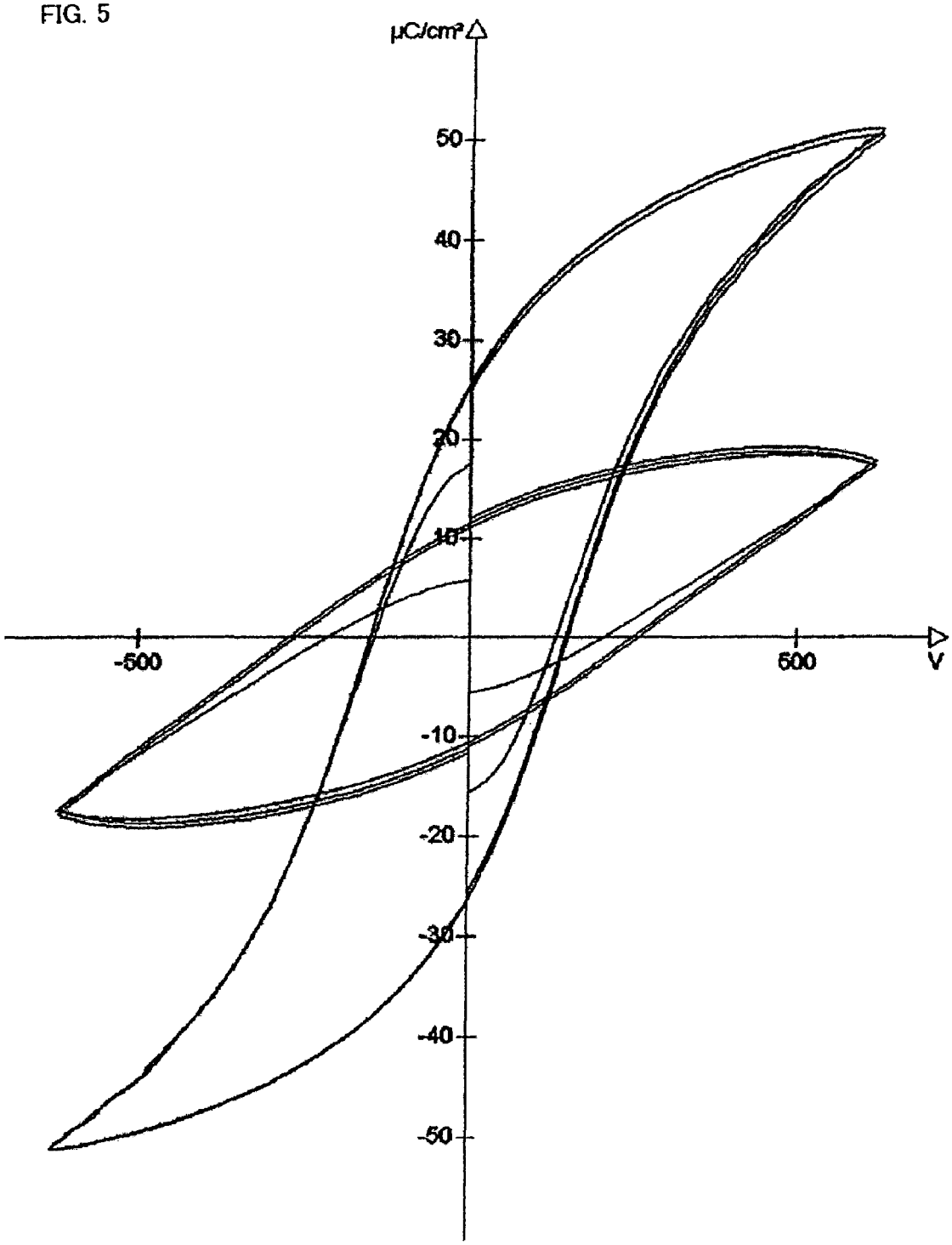
FIG. 5 shows the results obtained for the D-E hysteresis characteristics of the composite structure body and the PZT single phase both involved in Example 2.

A composite structure body was formed on a SUS304 substrate at room temperature with the mixed powder composed of aluminum oxide (50 wt %) and lead titanate zirconate (PZT) (50 wt %) by means of the ultra-fine particles beam deposition method in the present invention. FIG. 5 shows the result of the D-E hysteresis measurement of the structure body.

Figure 6:
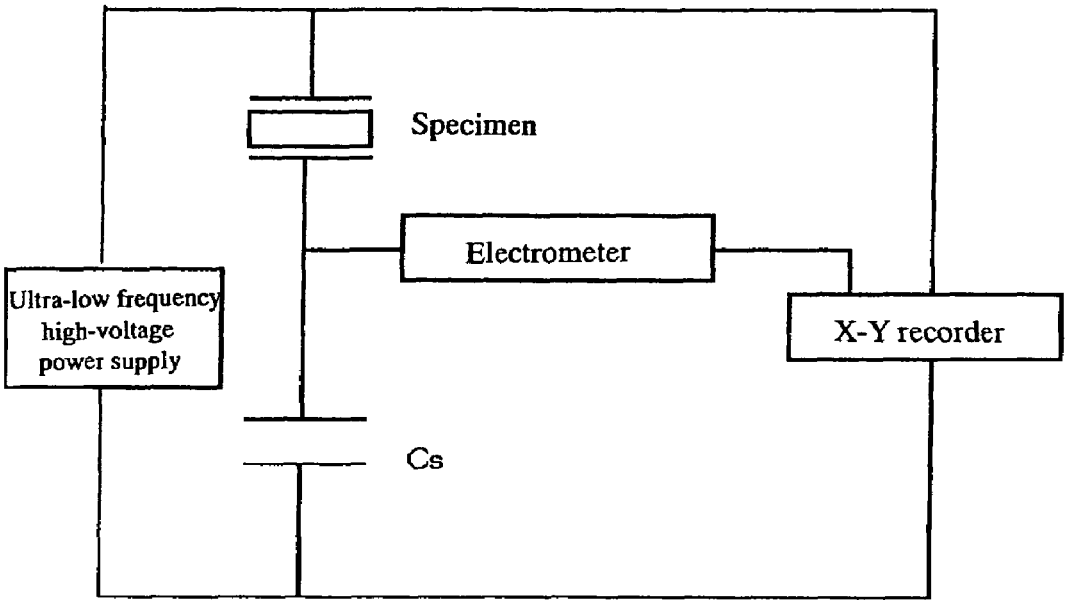
FIG. 6 shows the diagram of the Sawyer-Tower circuit involved in Example 2.

The measurement specimen was prepared as follows: for the purpose of the D-E characteristic measurement, the surface of the structure body was polished to a thickness of 18 μm on a glass plate with a diamond paste of 1 μm in particle size, the surface was washed and dried, a gold electrode was formed on the upper surface of the structure body in a size of ϕ5 mm by the vacuum deposition method, and the structure body underwent a heating processing for one hour at 600° C. in the air atmosphere to make the measurement specimen. Incidentally, for the purpose of comparative consideration of the physical properties of the aluminum oxide/PZT composite structure body manufactured this time, there was prepared in a similar manner a structure body manufactured with the PZT (100 wt %) raw material. The measurement was made by using the Sawyer-Tower circuit shown in FIG. 6 as the evaluation method of the D-E characteristics. In the measurement based on the Sawyer-Tower circuit, after the specimen was set, the specimen was applied a voltage of about ±700 V at the frequency of 10 Hz, the charge quantity at that time was read on an electrometer (manufactured by Advantest Co., TR8652), and recorded on an X-Y recorder (manufactured by Yokogawa Electric Co., analyzing recorder, Model 3655E) to depict the D-E hysteresis loop. From the D-E hysteresis loop, the voltages (V+, V−) at which the charge quantity (D) vanished, namely, the voltages at which the polarization of the feroelectric phase was reversed, were respectively read; the voltage values thus obtained were divided by the thickness of the structure body used for measurement to calculate the coercive fields (E+, E−), and the hardness against the external electric field was compared. Furthermore, the charge quantities (D+, D−) at the vanishing applied voltage were read and were divided by the electrode area (ϕ5 mm) to obtain the residual polarizations (Pr+, Pr−), from which the degree of orientation of the specimen in relation to the electric field was obtained.

It was revealed that in the composite structure body manufactured according to the present invention, the D-E loop showed hysteresis, although the structure body contained aluminum oxide in the content of 50 wt %. However, in the structure body containing PZT in the content of 100%, the residual polarization (Pr) and hysteresis were small, but the coercive fields were obtained to be larger by a factor of about 2.

Figure 7:
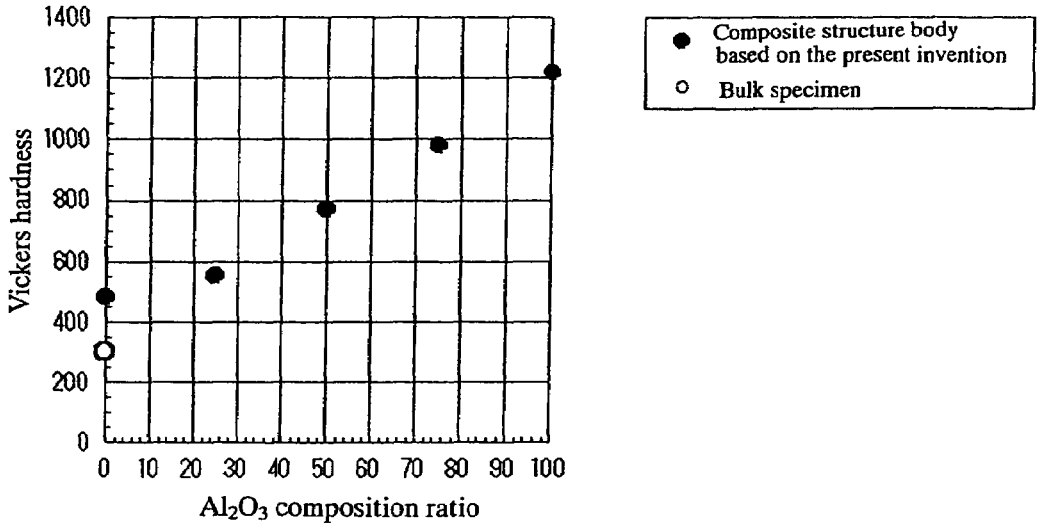
FIG. 7 shows the measured results of the Vickers hardness of the composite structure body involved in Example 2 in relation to the $Al_2O_3$ composition ratio.

Furthermore, FIG. 7 shows the micro-Vickers hardness measurement results on the composite structure body manufactured in the present invention. There was obtained the results that with increasing content of aluminum oxide, the Vickers hardness of the composite structure body was increased. Just for reference, FIG. 7 also shows the result of the hardness measurement on a PZT bulk specimen manufactured by the sintering at 1300° C. for 2 hours; there was obtained an interesting result that the composite structure body manufactured in the present invention showed the hardness by about 1.5 times higher than that of the bulk specimen. Incidentally, the hardness values of the structure bodies were measured at 5 points by use of a Dynamic Ultra Micro Hardness Tester, DUH-W201, manufactured by Shimadzu Corp., with the Vickers indenter applied for 15 seconds with the load of 50 gf, and the values of the 5 points were averaged.

EXAMPLE 3

Figure 8:
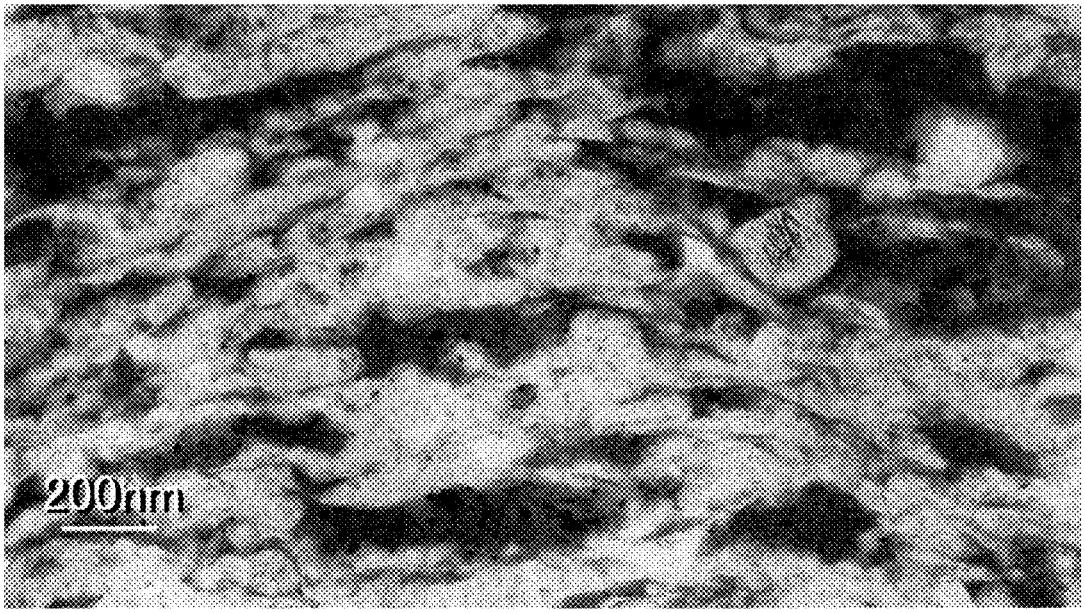
FIG. 8 is the transmission electron microscope photograph of the PZT/$Al_2O_3$ composite structure body involved in Example 3.

In a manner similar to that in Example 2, a composite structure body was manufactured at room temperature on a SUS 304 substrate with the mixed powder composed of aluminum oxide (80 wt %) and PZT (20 wt %). FIG. 8 shows the transmission electron microscope (TEM) observation image of the obtained structure body. From the EDX element analysis, it has been revealed that in the photograph, the white grain shows the aluminum oxide and the black grain shows the PZT. From these results, it was found that the composite structure body manufactured by the aerosol deposition method, which constitutes the present invention, was formed with the two phases coexisting due to no occurrence of the reaction between aluminum oxide and PZT. Incidentally, the results of the TEM observations revealed that the aluminum oxide fine particles and the PZT fine particles were reduced in particle size in such a way that, in either type of particles, the raw particle size ranged from 0.6 to 0.8 μm at the starting time, but the grain size in the composite structure body was reduced to be as small as about 0.2 μm, and furthermore revealed that the composite structure body was a film distorted and oriented in layers along the direction perpendicular to the bombardment direction of the particles. Furthermore, the abundance ratio between the aluminum oxide and PZT in the structure body was also found to be almost the same as that in the mixed powder at the starting time.

From the observed results, it was revealed that the aluminum oxide phase and PZT phase were present independently without forming solid solution. Additionally, this fact is the results suggesting that, as described in Example 2, the composite structure body manufactured in the present invention showed in the D-E characteristics the hysteresis loop smaller that of the PZT single-component composition, and furthermore the film hardness of the structure body was larger than that of the PZT single-component composition, and it became larger with increasing aluminum oxide abundance ratio.

EXAMPLE 4

In Example 4, description is made of the measurement of the fine particle velocity at the time of the formation of a structure body.

Figure 9:
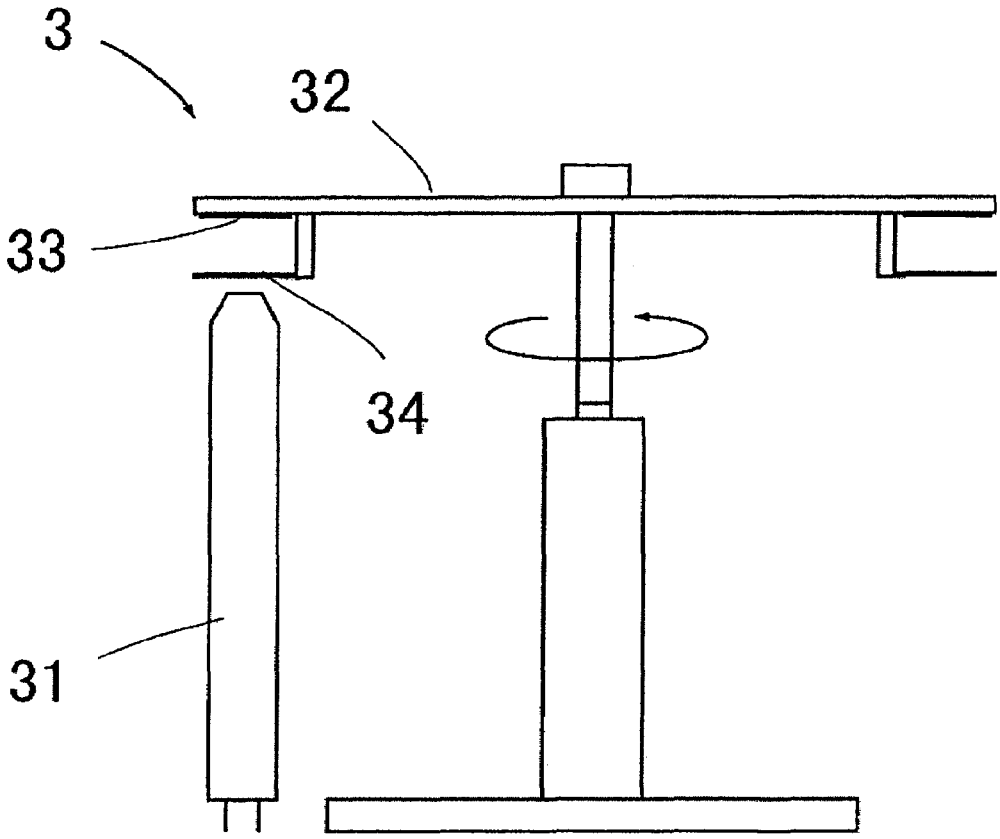
FIG. 9 shows a diagram illustrating an apparatus for measuring the fine particle velocity.

The following method was used for the above described measurement of the fine particle velocity. FIG. 9 illustrates an apparatus for measuring the fine particle velocity. There is arranged an apparatus 3 for measuring the fine particle velocity in which apparatus a nozzle 31 for spraying the aerosol into the interior of the chamber unshown in the figure is arranged with the opening thereof directed upward, and there are arranged in front of the opening a substrate 33 mounted on the peripheral end of a rotary vane 32 which is driven to revolve by a motor, and a slit 34 which is fixed at a position separated by 19 mm downward from the substrate surface and has a notch of 0.5 mm in width. The separation between the opening of the nozzle 31 and the substrate surface is 24 mm. In the next place, a description is made of the method for measuring the fine particle velocity. The spray of the aerosol is conducted in conformity with the actual method for manufacturing the composite structure body. It is suitable to conduct the spray of the aerosol by arranging, in the structure body formation chamber, the apparatus 3 for measuring the fine particle velocity, shown in the figure, in place of the substrate for forming a structure body. Under a reduced pressure, the pressure of the chamber unshown in the figure is reduced to be several kPa or less, and then the aerosol containing fine particles is sprayed from the nozzle 31; under this condition, the apparatus 3 for measuring the fine particle velocity is driven to operate at a constant rotational speed. As for the fine particles ejected from the opening of the nozzle 31, when the substrate 33 comes above the nozzle 31, a part of the fine particles pass through the notch clearance of the slit 34 and are bombarded against the substrate surface to form a structure body (impact scar) on the substrate 33. While the fine particles reach the substrate surface separated by 19 mm from the slit, the substrate 33 is made to vary its position by the rotation of the rotary vane 32; so that the fine particles are bombarded against a position on the substrate 33 displaced by the above described position variation from the intersecting position of the perpendicular line dropped from the notch of the slit 34. The distance from the intersecting position of the perpendicular line to the structure body formed through the bombardment was measured by the surface irregularity measurement; as for the velocity of the fine particles sprayed from the nozzle 31, there was calculated the average velocity over the range from the position separated by 5 mm to the position separated by 24 mm from the opening of the nozzle 31, by using this distance, the distance from the substrate surface to the slit 34, and the rotational speed of the rotary vane 32, and this average velocity was defined as the fine particle velocity in the present invention.

INDUSTRIAL APPLICABILITY

As described above, the composite structure body involved in the present invention can provide a novel material having properties that cannot otherwise be provided, because in the composite structure body, more than one types of brittle materials are combined to form a composite material at the nano level size.

Additionally, according to the method for manufacturing the composite structure body involved in the present invention, not only the film type but also arbitrary, 3-dimensional shaped composite structure bodies can be manufactured, so that the application of these structure bodies can be extended to all fields.

Furthermore, in the formation of the composite structure body on a substrate, it is possible to choose arbitrary substrates because the processes involved are conducted at low temperatures (about room temperature), but are not involved in heating, sintering, or the like.

Although there have been described what are the present embodiments of the invention, it will be understood by persons skilled in the art that variations and modifications may be made thereto without departing from the spirit or essence of the invention.

The invention claimed is:

1. A structure body in which crystals of first brittle materials including at least one of ceramics, semiconductors, and metalloids, and crystals and/or microstructures of second brittle materials other than said first brittle materials are dispersed, wherein: a portion composed of the crystals of said brittle materials is polycrystalline; substantially no boundary layer composed of a glassy substance is present in a boundary face thereof; an average crystallite size in said polycrystalline portion is 500 nm or less, and a denseness degree of the composite structure body is 70% or more.

2. The structure body according to claim 1, wherein in said polycrystalline portion an average crystallite size is 100 or less and a denseness degree of the composite structure body is 95% or more.

3. The structure body according to claim 1, wherein in said polycrystalline portion an average crystallite size is 50 nm or less and a denseness degree of the composite structure body is 99% or more.

4. The structure body according to claim 1, wherein in said polycrystalline portion substantially lacks crystalline orientation.

5. A composite structure body in which on a surface of a substrate is formed a structure body in which crystals of first brittle materials including at least one of ceramics, semiconductors, and metalloids, and crystals and/or microstructures of second brittle materials other than said first brittle materials are dispersed, wherein: a part of said structure body becomes an anchor portion biting the substrate surface; a portion composed of the crystals of said brittle materials is polycrystalline; substantially no boundary layer composed of a glassy substance is present in a boundary face thereof; in said polycrystalline portion an average crystallite size is 500 nm or less and a denseness degree of the composite structure body is 70% or more.

6. The composite structure body according to claim 5, wherein the crystals constituting said polycrystalline portion are not accompanied by thermal grain growth.

7. The composite structure body according to claim 5, wherein in said polycrystalline portion an average crystallite size is 100 nm or less and a denseness degree of the composite structure body is 95% or more.

8. The composite structure body according to claim 5, wherein in said polycrystalline portion an average crystallite size is 50 nm or less and a denseness degree of the composite structure body is 99% or more.

9. The composite structure body according to claim 5, wherein the crystals constituting said polycrystalline portion are 2.0 or less in aspect ratio.

10. The composite structure body according to claim 5, wherein elements other than a main metal element constituting the crystals are not segregated in the boundary face between the crystals constituting said polycrystalline portion.

11. The composite structure body according to claim 5, wherein there is a nonstoichiometric composition portion in the vicinity of the boundary face between the crystals constituting said structure body.

12. The composite structure body according to claim 11, wherein at least one type of said crystals comprises metal oxide, and said nonstoichiometric composition portion displays the nonstoichiometric characteristic based on oxygen deficiency or surplusage in said metal oxide.

13. The composite structure body according to any of claim 5, wherein said substrate is glass, a metal, a metalloid, a semiconductor, a ceramic, or an organic compound.

14. The composite structure body according to claim 5, wherein in said polycrystalline portion substantially lacks crystalline orientation.

15. A composite structure body which is obtained through the following processes: by bombarding fine particles of more than one type of brittle material separately or simultaneously against a surface of a substrate at high velocities, whereby an anchor portion biting said substrate surface is formed; the fine particles of said more than one type of brittle material are simultaneously distorted or fractured by impact of the bombardment; mutual rejoining of the brittle material fine particles is made through intermediary of a newly generated active surface formed by the distortion or fracture; and thereby is formed a structure in which the crystals and/or microstructures of the brittle materials are dispersed above and joined to said anchor portion, and thus the composite structure body is obtained.

16. The composite structure body according to claim 15, further including a process of imparting internal distortion to said brittle material fine particles, as pre-processing prior to said impact.

17. The composite structure body according to claim 15, wherein said brittle material fine particles are 0.1 to 5 μm in average particle size.

18. The composite structure body according to claim 15, wherein said processes are conducted at room temperature.

19. The composite structure body according to claim 15, further including a process of structure control conducted by heat processing at temperatures not higher than a melting point of said composite structure body, after the formation of said composite structure body.

20. The composite structure body according to claim 15, wherein said processes are conducted under a reduced pressure.

21. The composite structure body according to claim 15, wherein the process for bombarding fine particles against said substrate surface at a high velocity involves spraying aerosol, in which said fine particles are dispersed in a gas, against said substrate at a high velocity.

22. The composite structure body according to claim 21, wherein the composite structure body is further obtained by controlling elemental quantities in compounds constituting the structure body composed of said brittle materials through controlling a type of and/or partial pressures in said gas.

23. The composite structure body according to claim 21, wherein the composite structure body is further obtained by controlling oxygen quantity in the structure body composed of said brittle materials through controlling oxygen partial pressure in said gas.

24. The composite structure body according to claim 21, wherein the composite structure body is further obtained by controlling electric, mechanical, chemical, optical, and magnetic characteristics of said composite structure body through controlling a type of and/or partial pressures in said gas.

25. The composite structure body according to claim 21, wherein the composite structure body is further obtained by controlling electric, mechanical, chemical, optical, and magnetic characteristics of said composite structure body through controlling oxygen partial pressure in said gas.

26. A composite structure body which is obtained through the following processes: forming composite fine particles by way of a process in which a surface of the fine particles of a brittle material is coated with another brittle material; then by bombarding said composite fine particles against a surface of a substrate at high velocities, an anchor portion biting said substrate surface is formed; said composite fine particles are simultaneously distorted and fractured by impact of the bombardment; mutual rejoining of said composite fine particles is made through intermediary of a newly generated active surface formed by the distortion or fracture; and thereby forming a structure body in which crystals and/or microstructures of the brittle materials are dispersed above said anchor portion.

27. A composite structure body which is obtained through the following processes: arranging fine particles of more than one type of brittle material on a surface of a substrate; exerting mechanical impact to the brittle material fine particles to form an anchor portion biting said substrate surface; simultaneously said brittle material fine particles are deformed or fractured by the mechanical impact; mutual rejoining of said fine particles is made through intermediary of a newly generated active surface formed by the distortion or fracture; and thereby forming a structure body composed of structures in which crystals and/or microstructures of the more than one type of brittle material are dispersed above said anchor portion.

28. A composite structure body which is obtained through the following processes: forming composite fine particles by way of a process in which a surface of fine particles of a brittle material is coated with another brittle material; then arranging said composite fine particles on a surface of a substrate; an anchor portion biting said substrate surface is formed by exerting mechanical impact to the composite fine particles; said composite fine particles are simultaneously deformed or fractured by the mechanical impact; mutual rejoining of said composite fine particles is made through intermediary of a newly generated active surface formed by the distortion or fracture; and thereby forming structure body composed of the structure in which crystals and/or microstructures of the brittle materials are dispersed above said anchor portion.

* * * * *

UNITED STATES PATENT AND TRADEMARK OFFICE

CERTIFICATE OF CORRECTION

PATENT NO. : 7,255,934 B2
APPLICATION NO. : 10/399898
DATED : August 14, 2007
INVENTOR(S) : Hatono et al.

It is certified that error appears in the above-identified patent and that said Letters Patent is hereby corrected as shown below:

Title page:
In the "(57) ABSTRACT",
line 2, change "types of brittle materials" to -- type of brittle material --;
line 6, change "lacks the crystalline" to -- lack the crystalline --;
line 10, change "types of brittle materials" to -- type of brittle material --.

Column 1:
Line 8, change "types of brittle materials" to -- type of brittle material --.

Column 2:
Line 60, change "the above descried" to -- the above described --.

Column 3:
Lines 5-6, change "different more than one types of ceramics" to -- different, more than one type of, ceramics --.
Lines 42-43, change "types of brittle materials" to -- type of brittle material --

Column 4:
Line 33, change "types of brittle materials" to -- type of brittle material --.

Column 5:
Line 66, change "constituent grain" to -- constituent grains --.

Column 6:
Line 33, change "from the fracturing and to" to -- from the fracturing to --.

Column 7:
Line 7, change "tungsten bonde" to -- tungsten boride --.

Column 8:
Line 1, change "types of the brittle materials" to -- type of the brittle material --.
Line 10, change "types of brittle materials" to -- type of brittle material --.
Line 58, change "types of brittle materials" to -- type of brittle material --.

Column 10:
Lines 64-65, change "types of brittle materials" to -- type of brittle material --.

UNITED STATES PATENT AND TRADEMARK OFFICE

CERTIFICATE OF CORRECTION

PATENT NO. : 7,255,934 B2
APPLICATION NO. : 10/399898
DATED : August 14, 2007
INVENTOR(S) : Hatono et al.

It is certified that error appears in the above-identified patent and that said Letters Patent is hereby corrected as shown below:

Column 11:
Line 57, change "which are based" to -- which is based --.

Column 12:
Line 14, change "mixed power" to -- mixed powder --.

Column 15:
Line 23, change "feroelectric" to -- ferroelectric --.

Column 16:
Line 26, change "smaller that" to -- smaller than that --.

Column 17:
Line 26, change "types of brittle materials" to -- type of brittle material --.
Line 56, change "size is 100" to -- size is 100 nm --.
Line 63, change "wherein in" to -- wherein --.

Column 18:
Line 41, change "according to any of" to -- according to --.
Line 45, change "wherein in said " to -- wherein said --.

Column 20:
Line 35, change "forming structure" to -- forming a structure --.

Signed and Sealed this

Twenty-fifth Day of December, 2007

JON W. DUDAS
*Director of the United States Patent and Trademark Office*